United States Patent [19]

Herrington

[11] Patent Number: 4,714,455

[45] Date of Patent: Dec. 22, 1987

[54] HEM FOLDER WITH INTEGRAL TAPE INSERTER FOR MAKING DRAW TAPE BAGS

[75] Inventor: Fox J. Herrington, Holcomb, N.Y.

[73] Assignee: Mobil Oil Corporation, New York, N.Y.

[21] Appl. No.: 871,238

[22] Filed: Jun. 6, 1986

[51] Int. Cl.[4] ..... B31B 1/90

[52] U.S. Cl. ..... 493/225; 493/223; 493/248; 493/928; 493/196

[58] Field of Search ..... 493/193, 194, 196, 223, 493/225, 229, 231, 237, 248, 251, 438–440, 446, 447, 455, 456, 459, 928

[56] References Cited

U.S. PATENT DOCUMENTS

| | | | |
|---|---|---|---|
| 2,348,196 | 5/1944 | Duhaime | 493/248 |
| 2,897,729 | 8/1959 | Ashton et al. | 493/196 |
| 3,029,853 | 4/1962 | Piazze | 383/75 |
| 3,058,402 | 10/1962 | Kugler . | |
| 3,058,403 | 10/1962 | Kugler | 493/194 |
| 3,406,610 | 10/1968 | Golden . | |
| 3,414,032 | 12/1968 | Jortikka . | |
| 3,759,772 | 9/1973 | Andersson . | |
| 3,812,769 | 5/1974 | Barnes et al. | 493/196 |
| 4,055,109 | 10/1977 | Kan | 493/196 |
| 4,202,721 | 5/1980 | Roberts . | |
| 4,597,750 | 7/1986 | Boyd et al. | 493/225 |
| 4,617,008 | 10/1986 | Boyd et al. | 493/248 |

FOREIGN PATENT DOCUMENTS 1125363 8/1968 United Kingdom .

*Primary Examiner*—Frederick R. Schmidt
*Assistant Examiner*—Robert Showalter
*Attorney, Agent, or Firm*—Alexander J. McKillop; Michael G. Gilman; Charles J. Speciale

[57] ABSTRACT

Draw tape bags are made with folding surfaces which decrease in width to the final bag height. One edge of each side of a moving web of film is tucked onto a side of a surface to produce a hem in each edge of the moving web. Rollers, which are canted with respect to the direction of movement of the web, pull the hem of the film tight against the surface to insure that the web is at the final bag length when the web leaves the surfaces.

12 Claims, 13 Drawing Figures

HEM FOLDER WITH INTEGRAL TAPE INSERTER FOR MAKING DRAW TAPE BAGS

BACKGROUND OF THE INVENTION

This invention relates to the manufacture of draw tape plastic bags and more particularly to making a hem in the bags for holding the tape.

Bags made of thin polyethylene material have been used in various sizes. Small bags are used in the packaging of sandwiches and the like; larger bags are used as shopping bags; and even larger bags are used for containing trash.

A particularly advantageous closue for such a bag includes a draw tape constructed from the same polyethylene material. U.S. Pat. No. 3,029,853—Piazzi, and British Pat. No. 1,125,363—Jortikka are examples of draw tape bags. Such closures have been successfully employed on these bags.

Draw tape closures for large trash bags, and the manufacture of these draw tape trash bags, are described in the related applications identified below.

Forming the hem, into which the draw tap is inserted, is shown, for example, in U.S. Pat. Nos. 2,897,729—Ashton et al, 3,058,402—Kugler and in METHOD AND APPARATUS FOR FORMING HEMS IN SUPERPOSED PLIABLE PANELS, Boyd et al, Ser. No. 652,255, filed Sept. 20, 1984, now U.S. Pat. No. 4,617,008.

One of the problems encountered in prior art hem forming apparatus is brought about by sharp turns in the direction of the moving web of film which forms the bag. It is desirable to move this web smoothly in one direction without sharp turns, even during the hem forming operation. The sharp turns create drag which makes it difficult to control the tension in the web.

Polyethylene is extensible to some extent, which makes it easier to process and form than stiffer materials such as polystyrene, paper or cellophane. Nevertheless, forming apparatus for polyethylene must move the web smoothly and without distortion. Any movement that requires one portion of the moving web to travel a longer path than another introduces distortion.

It is an object of the present invention to fold a hem in a moving web of film without drastically altering the direction of movement of the web.

It is another object of the present invention to form hems in the opposing panels of a moving web of folded thermoplastic film in the manufacture of draw tape bags.

RELATED APPLICATIONS

METHOD & APPARATUS FOR MANUFACTURING DRAW TAPE BAGS Boyd, et al, Ser. No. 652,254, filed Sept. 20, 1984, now U.S. Pat. No. 4,624,654, describes an overall draw tape bag manufacturing line; METHOD & APPARATUS FOR FORMING HEMS IN SUPERPOSED PLIABLE PANELS, Boyd et al, Ser. No. 652,255, filed Sept. 20, 1984 now U.S. Pat. No. 4,617,008, describes a hem forming apparatus used with the line; INSERTION OF DRAW TAPE STRIPS IN DRAW TAPE BAG MANUFACTURE, Boyd et al, Ser. No. 652,252, filed Sept. 20, 1984, now U.S. Pat. No. 4,597,750, describes the apparatus for inserting the draw tape into the bag. The foregoing applications are incorporated herein by reference.

SUMMARY OF THE INVENTION

In making a draw tape bag, the hem is folded and the tape is inserted concurrently, by passing the film over a pair of surfaces that are joined together to form a shape like a boat. Each surface is a board, or a frame which defines the edges of the surface. The hems are folded over the edges of the surfaces, and the tape is inserted by running it between the surfaces, then out through slots in the board.

At the point where the film first enters the folder, the surfaces are wider than the full width of the web of film. As the surfaces reaches the peak (where the two surfaces are at their maximum distance apart), the width of the surface has decreased to where it is equal to the final bag height after folding the hem. In the course of this travel, the width of the surface has decreased linearly. From this point, the board width remains constant.

The segment of the film which gets folded over for the hem drops over the edge of the surface along its taper, and then is pushed against the opposite surface by tucker bars. As the film nears the end of its travel along the surface, it is drawn laterally around the edge of the surface by diagonally-oriented rubber wheels or rollers, that cause the film to be drawn tightly about the surface, thus accurately establishing the bag height. These rollers are canted with respect to the direction of movement of the film to draw the film lightly against the edge of the board.

The tape is inserted by running it through a slot in the surface, near the peak. From this point on, it follows precisely with the hem of the film.

The present invention is better than folding the film over the edge of a board because it does not cause as much drag, so there is better control of film tension. The canted wheels, or rollers, of the invention pull the film tight around the surfaces establishing a more accurate bag length. (The dimension transverse to direction of film travel is bag length which should be accurate in order to save material.) The tape insertion, concurrent with hem folding, positions the tape more accurately, permitting cost saving by allowing the hem to be no wider than necessary.

In an improved embodiment of the invention, the hem forming surface is a true plane which avoids distortion in the film as it travels. Both sides of the surface are canted inwardly to form the area of decreasing width. In this embodiment, the two surfaces are separated on each side. The folding surfaces are established by a sheet metal plate and the separation of the surfaces is established by a triangular sheet metal plate.

The foregoing and other objects, features and advantages of the invention will be better understood from the following, more detailed description and appended claims.

SHORT DESCRIPTION OF THE DRAWINGS

DESCRIPTION OF SPECIFIC EMBODIMENTS

Figure 1:
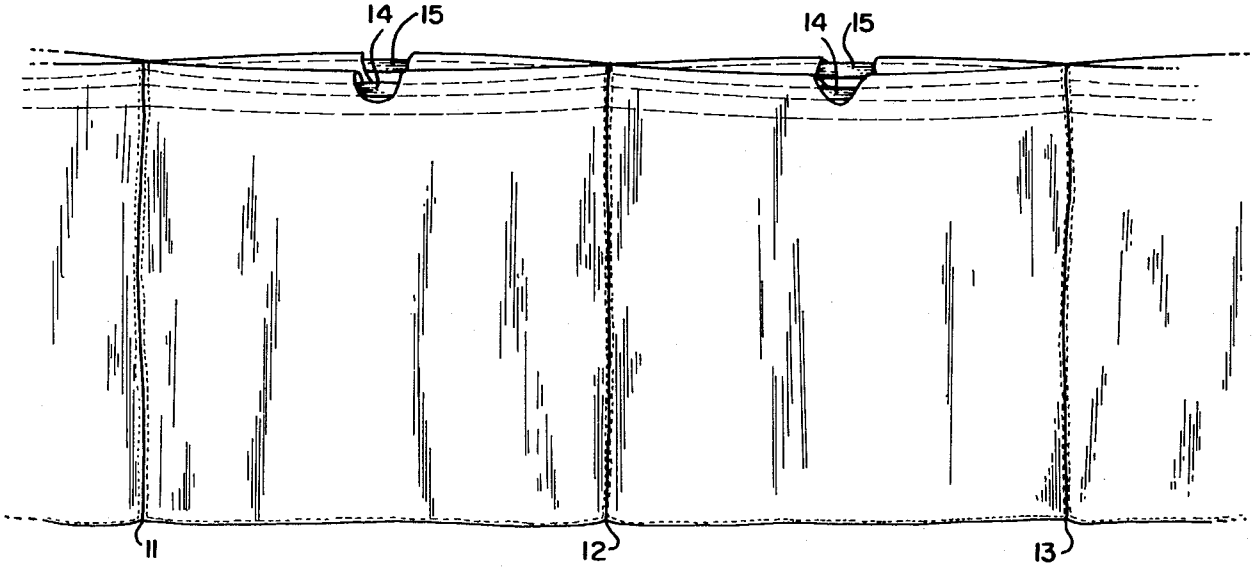
FIG. 1 shows a series of draw tape bags made in accordance with the present invention.

FIG. 1 shows a series of draw tape bags formed from an extruded tube of polyethylene. The tube is slit along one side to form open tops in the bag for reception of trash and the like. The tube of film is folded along the other side to form the bag bottoms. The sides of the panels are heat sealed and cut from the tube in a perpendicular direction at 11, 12 and 13 to form individual bags.

Hemmed portions of each opposing panel are folded over adjacent the top. Draw tapes 14 and 15 are inserted in the hems and are secured by the heat seal at the sides of the panels. Tape holes are cut in each panel exposing the draw tapes so that they can be grasped. The distance from the bottom of the bags to the top is referred to as "web width" or "bag length" herein.

Figure 2:
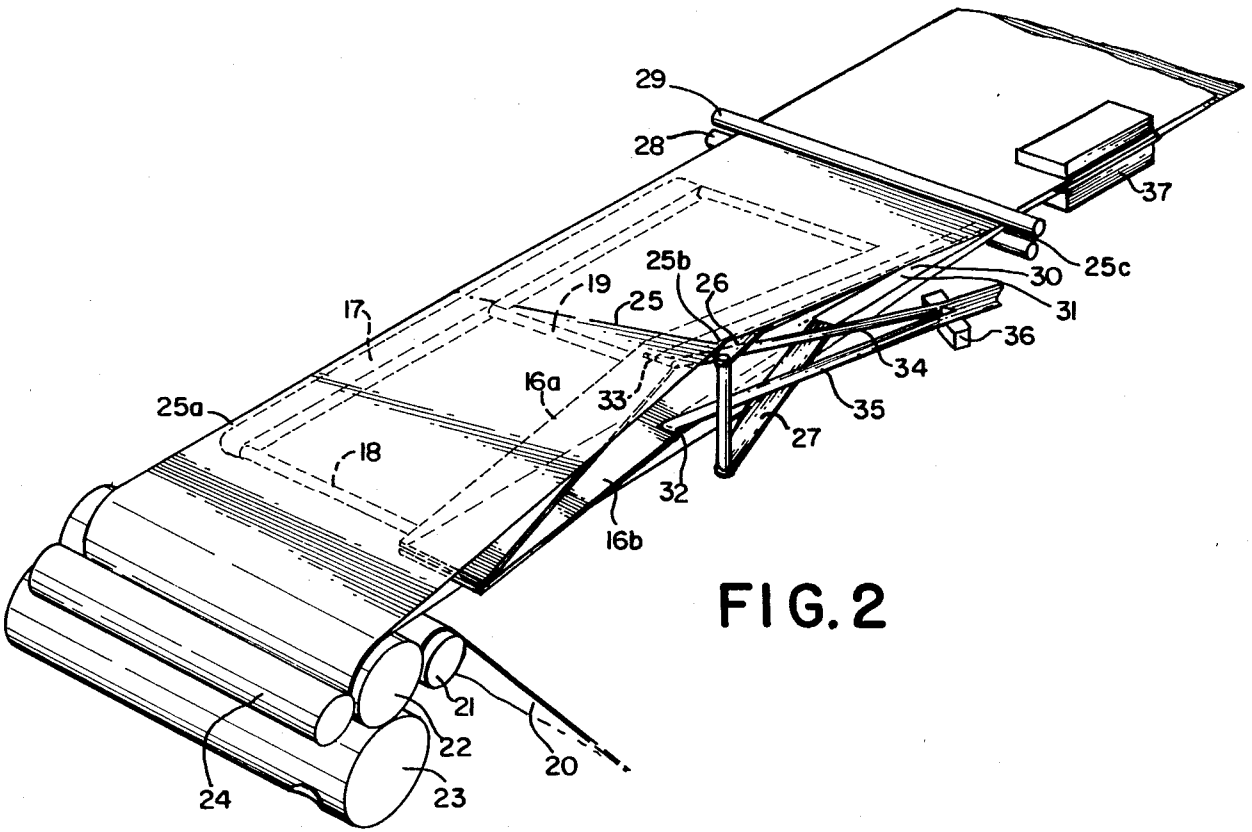
FIG. 2 is a perspective view depicting the hem forming apparatus of the present invention.

FIG. 2 depicts the hem forming apparatus of the present invention. It includes two folding surfaces with the top surface being made up of a hem plate **16*a* and the edge of bottom plate 17 separated by spacers 18 and 19. The other surface includes hem plate 16*b* and the edge of bottom plate 17**.

A moving web of film 20 is formed from an extruded tube of polyethylene which has been slit on the side facing the viewer and folded on the other side to form two opposing layers of film. This moving web enters the apparatus through rollers 21, 22, 23 and 24 with the roller 23 having punch elements which form the holes for grasping the tape.

Where the web impinges on the surfaces at **25*a*, the surfaces are wider than the final web width. The surface decreases in width to the final web width along the line 25. A layer of film passes over the outside of each surface. Tucker bars 26 and 27** tuck an edge of the moving web onto the other side of each surface to produce a hem in each opposing layer of film.

The surfaces are close together at **25*a* where the web first impinges on the surface and they diverge over the area of decreasing width to a maximum distance apart at the point 25*b* where the surfaces have the final bag length. The surfaces have a constant width from the point 25*b* to the point 25*c* where the webs leave the surfaces, at the position of the rolls 28 and 29**.

Figure 6:
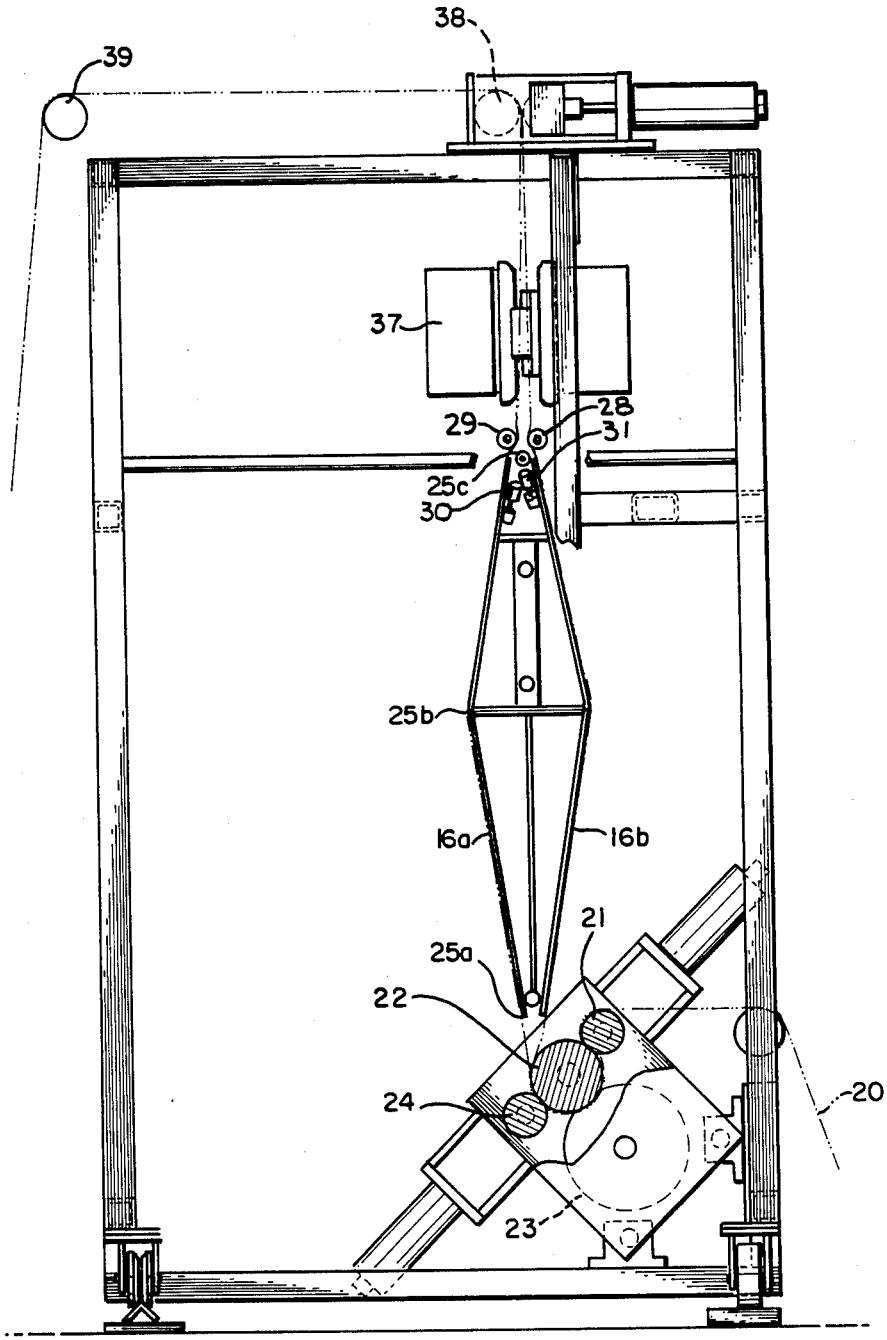
FIG. 6 is a front elevation view of the machine of FIG. 5.

Rollers 30 and 31 are canted with respect to the direction of movement of the web. The rollers are positioned to pull the hem of the film tight against the surface in the area of constant width. This insures that the web is at the final web width when it leaves the surface. (Rollers 30 and 31 are shown in FIG. 6 but only their location is indicated in FIG. 2).

Slots 32 and 33 in the surfaces receive tapes 34 and 35 which are inserted into the hems of the moving web of film. A tape slitter 36 produces two tapes from a single tape. A hem sealer 37 seals the folded over hem portion to the side panel of the bag so that the draw tape is secured in the hem of the bag.

Figure 3:
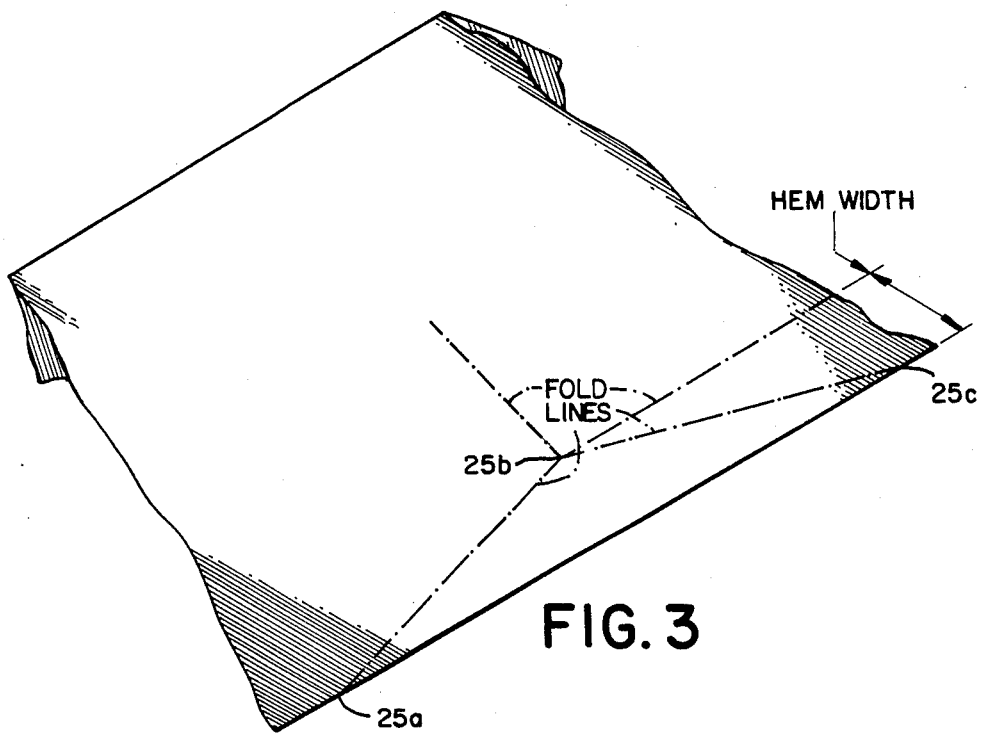
FIG. 3 shows the fold lines for the hem.

FIG. 3 depicts the fold lines which form the hem in the bag. The moving web decreases in width from the point **25*a* where it impinges on the surfaces to the point 25*b* which is at the maximum divergence of the surfaces. Before reaching the point 25*c***, where the film leaves the surfaces, the hem has been firmly pulled against the surfaces to insure that the web is at the final bag length.

Figure 4:
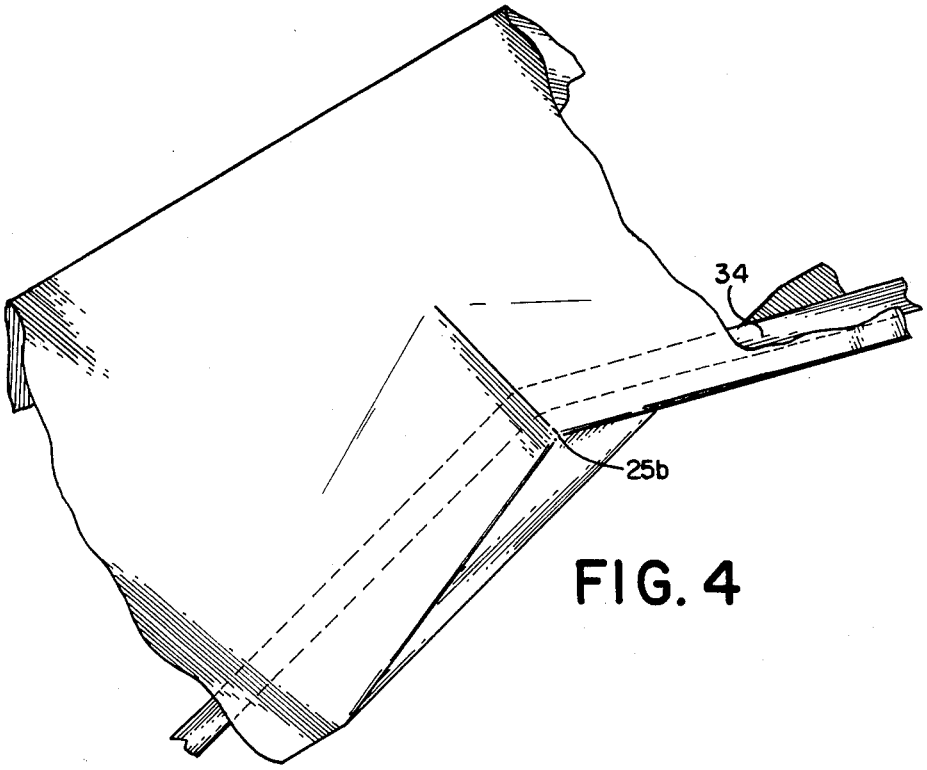
FIG. 4 depicts the hem being formed in the moving web of film.

FIG. 4 depicts the folding of the hem and the insertion of the tape 34 into the hem.

Figure 5:
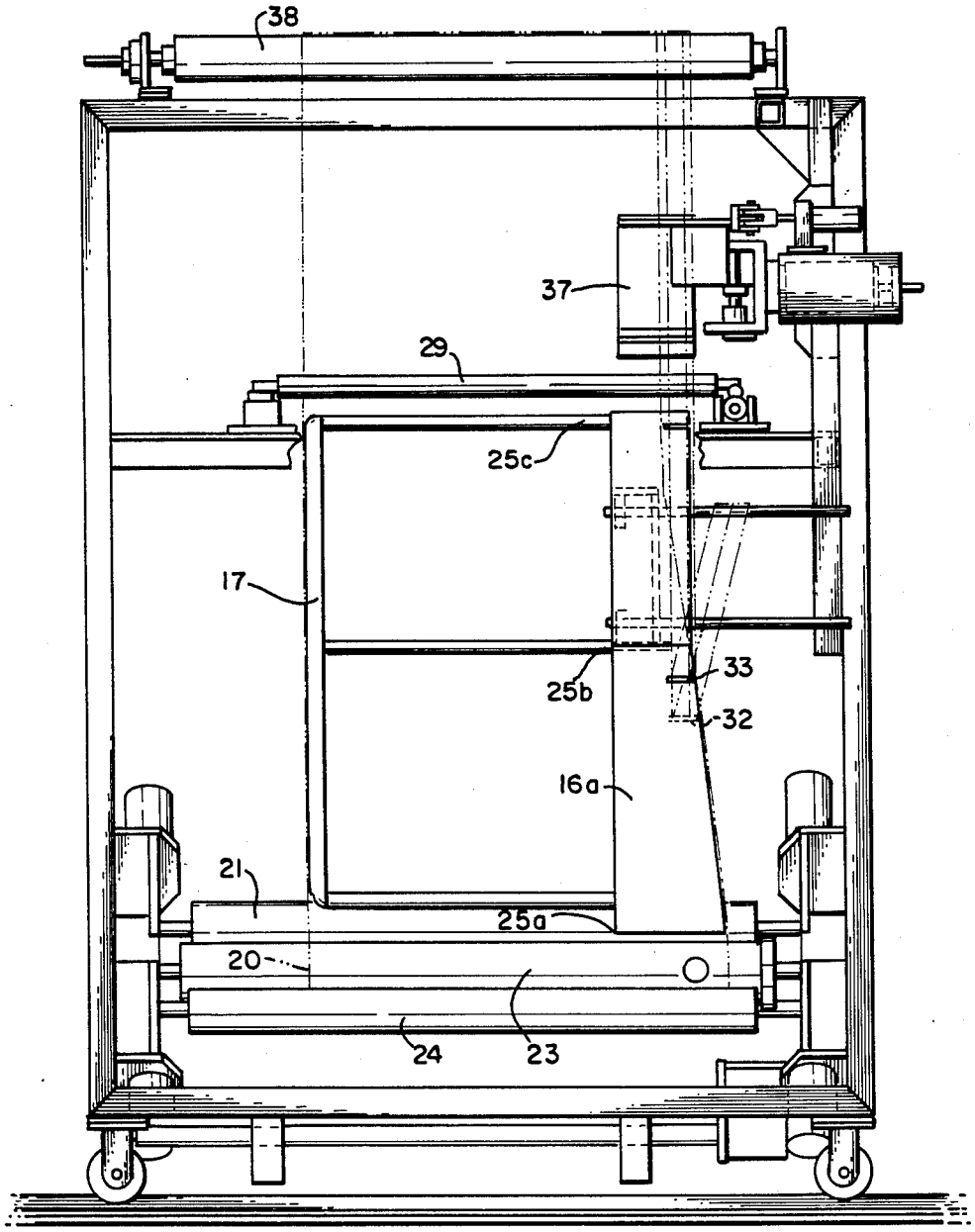
FIG. 5 is a side elevation view of a machine with the apparatus of the present invention.

FIGS. 5 and 6 depict the apparatus of the present invention in a hem forming machine. FIG. 6 shows the moving web of film 20 entering through rolls 21–24 with the roll 23 carrying punch elements which punch out the hole through which the tape is grasped. The hem plates **16*a* and 16*b* begin their divergence and reach the maximum divergence at 25*b*. From there, the surfaces again converge to the point 25*c*** at which the film leaves the surfaces.

FIG. 5 shows the manner in which the surfaces decrease in width from the point **25*a* to the point 25*b* and then are constant in width to the point 25*c*** where the film leaves the surfaces.

FIG. 6 shows the manner in which the rollers 28 and 29 are canted with respect to the direction of movement of the film to pull the film tightly against the surfaces. After the film leaves hem sealer 37, it passes through rolls 38 and 39 to the further processing steps of side sealing and cutting into individual bags.

Figure 7A:
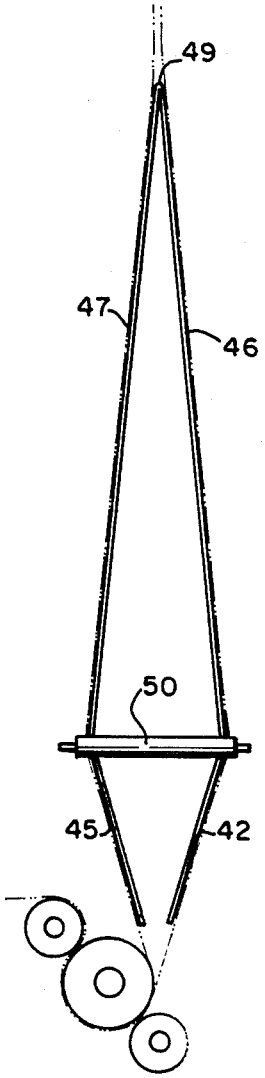
FIGS. 7A–7C are rear, side and front elevation views, respectively, of a modification of the invention.
Figure 7B:
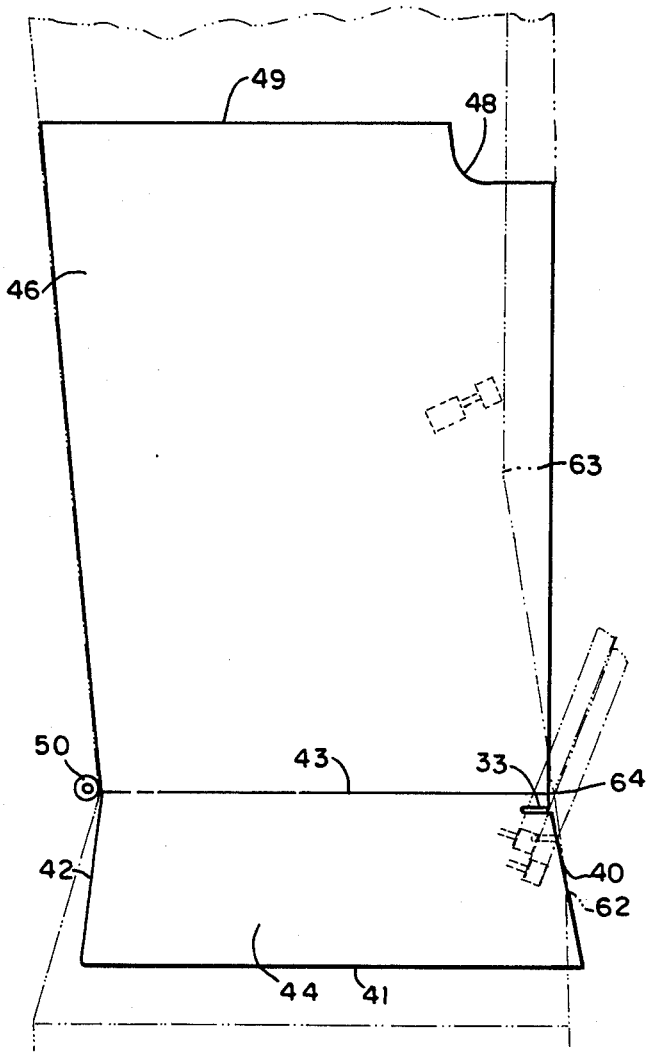
Figure 7C:
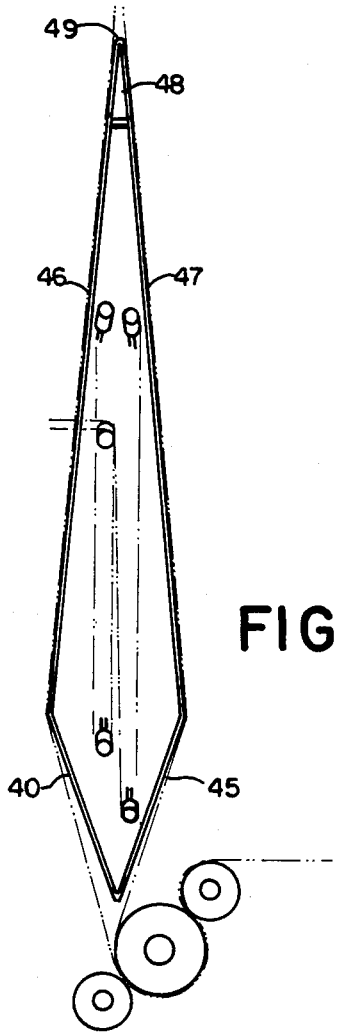

FIGS. 7A–7C show a modification wherein distortion in the film travel is avoided. In the embodiment depicted in FIG. 2, the surface formed by hem plate 16A, spacer 18, bottom plate 17, and the line 25 is not a true plane. It is skewed, and this causes distortion in the film as it travels. This is avoided in the embodiment of FIGS. 7A–7C, wherein the surface defined by the lines 40–43 is a true plane. In this embodiment, the folding surface defined by the lines 40–43 is a planar sheet metal plate 44. As best shown in FIGS. 7A and 7C, the two folding surfaces, the surface of plates 44 and 45, diverge on both sides. By this divergence, and by canting the edge defined by line 42 inwardly toward the edge defined by line 40, movement over a true plane is achieved.

The line 42 converges toward roller 50 by one-half the increased spacing between the surfaces. Because of this, a contant total film width is accommodated. Another advantage of the embodiment of FIGS. 7A and 7C is that this bag length can be easily changed. By moving the edge 42 outwardly, and the extension of this edge beyond line 43, the bag length can be increased without distortion.

Figure 7D:
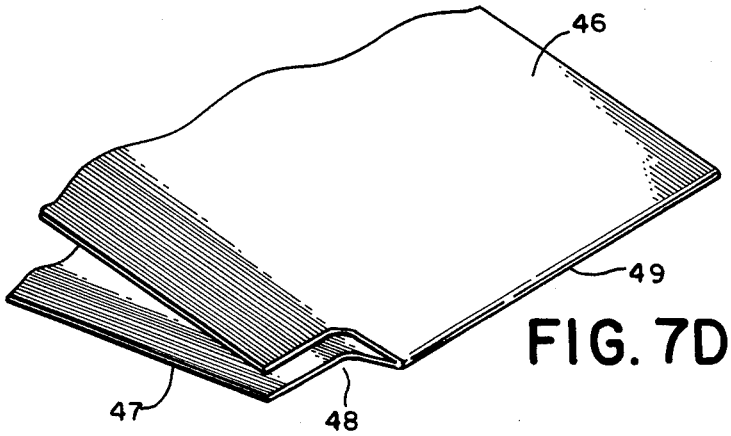
FIG. 7D shows a portion of the folding surface of FIGS. 7A–7C.

As viewed in FIGS. 7A and 7C, surfaces 46 and 47 converge to the line 49. This presents the problem that there is no room to let the hem out, so a cut-out area 48 has been provided, as shown in more detail in FIG. 7D. A different way to do this would be to distort the planes formed by the surfaces 46 and 47, but this is not desirable.

Figure 8A:
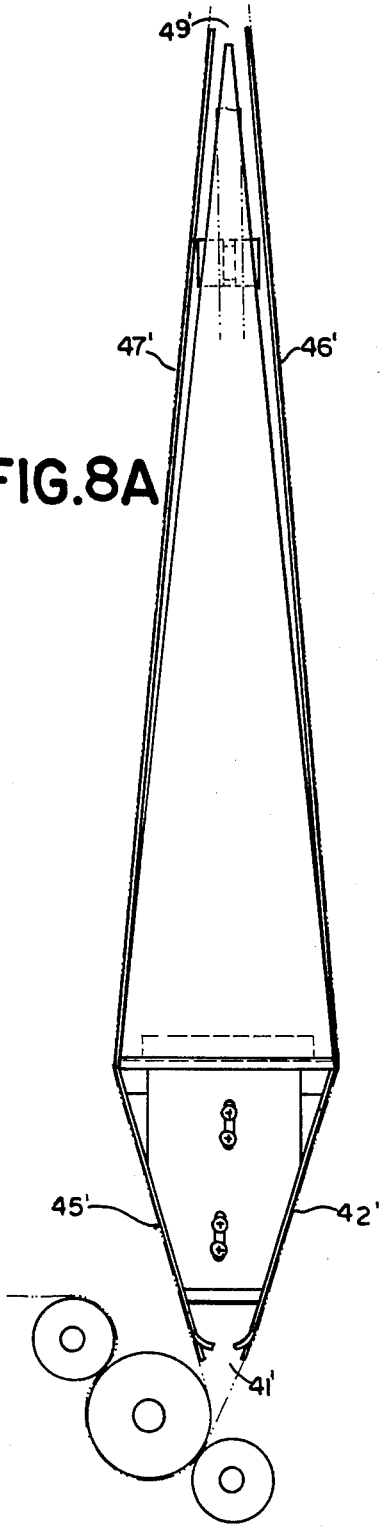
FIGS. 8A–8C are rear, side and front elevation views of a machine with the modification shown in FIGS. 7A–7C.
Figure 8C:
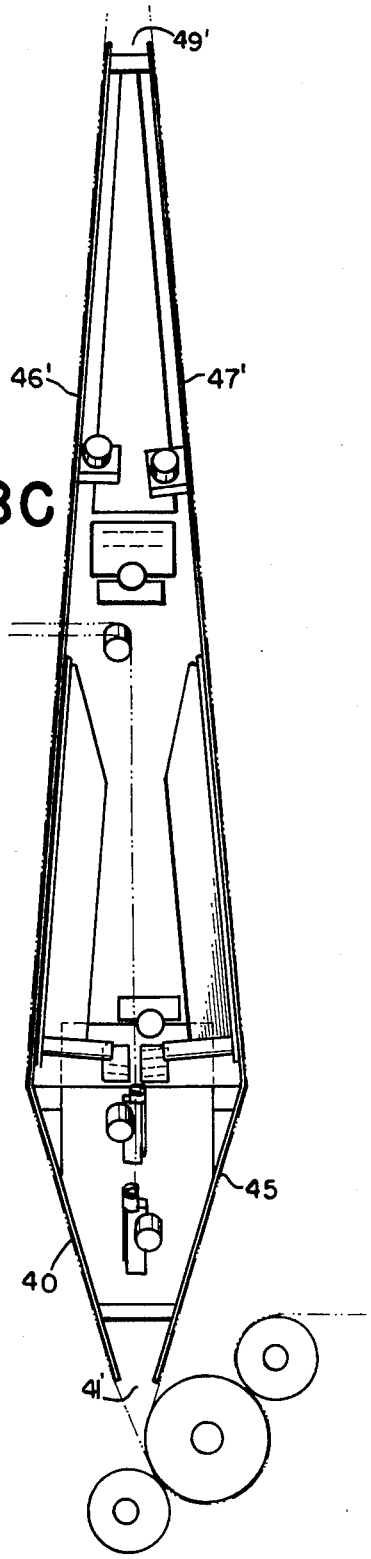
Figure 8B:
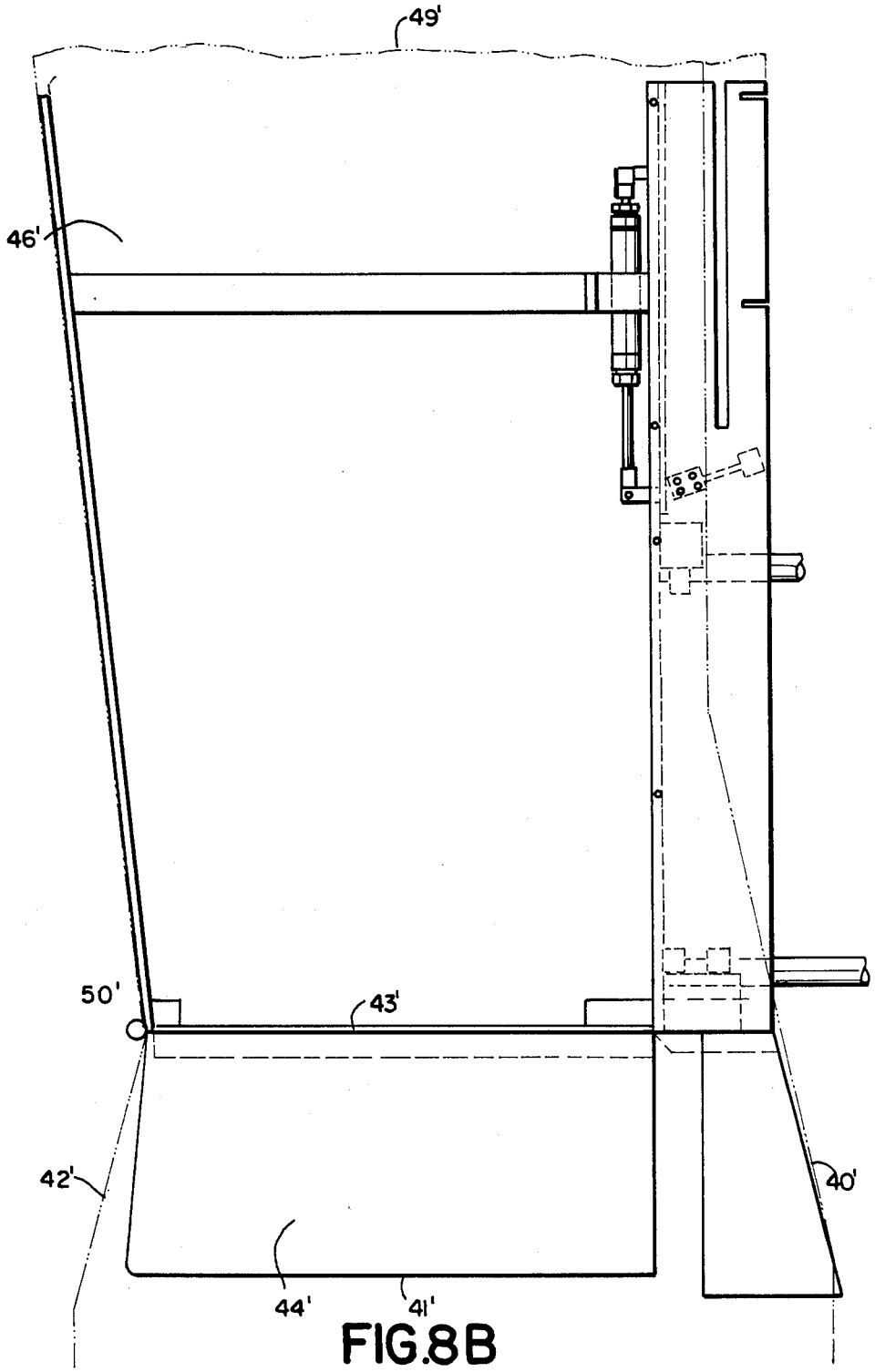

FIGS. 8A–8C show a preferred embodiment of the invention wherein primed reference numerals depict elements which perform functions similar to those in previous embodiments. The width of the moving web decreases on both sides to achieve the distortion free movement described with reference to FIGS. 7A–7C.

In the preferred embodiment of FIGS. 8A–8C, the surfaces 46' and 47' do not converge to a line. Space between the surfaces, where the bags leave the surface, allow room to let the hem out. Therefore, there is no need to provide a cut-out to let the hem out as in the previously described embodiment.

It is an important feature of the invention that the distance from the point 62 (FIG. 7B), where the film drops over the edge of plate 44, to the line 43, the maximum divergence of the plates, is less than the distance from the line 43 to point 63, where the film is fully tucked. With this relationship, the hem is turned outwardly at the point where the tape is inserted in the hem. If this relationship is not properly chosen, the hem will be turned in, making insertion of the tape difficult.

While a particular embodiment of the invention has been shown and described, various modifications are within the true spirit and scope of the invention. The appended claims are, therefore, intended to cover all such modifications.

What is claimed is:

1. A machine for making draw tape bags from a moving web of folded thermoplastic film having two folded faces, each having an edge comprising:

two spaced folding surfaces each having a width, over which said web impinges on said surfaces, wider than the final bag length, said surfaces decreasing in width to said final bag length to control said final bag length, one folded face of said web passing over one side of each of said surfaces;

means for tucking each edge of said web between said surfaces onto the other side of each surface to produce a hem in each edge of said web so that said web is at the final length of said bag upon leaving said surfaces;

slot in said surfaces in the area of said decreasing width; and means for feeding a tape through said slots into the hems of said moving web.

2. The machine recited in claim 1 further comprising:

rollers which are canted with respect to the direction of movement of said web, said rollers being positioned between said surfaces to pull the hem of said film tight against both of said surfaces upon leaving said surfaces to ensure that said web is at said final web length of said bag.

3. The machine recited in claim 1 wherein said surfaces are close together at said point wherein said web impinges on said surfaces.

4. The machine recited in claim 3 wherein said surfaces diverge over the area in which they are decreasing in width.

5. The machine recited in claim 4 wherein each surface forms a true plane for travel of said moving web, each surface having opposite edges canted inwardly with respect to the direction movement of said web, and wherein said surfaces diverge at said edges.

6. The machine recited in claim 1 wherein the distance from the point where said web drops over an edge of each surface to the point of maximum divergence of said surfaces is less than the distance from said point of maximum divergence to the point where said hem is fully tucked.

7. The machine recited in claim 1 further comprising:

a punch positioned to punch holes in the edges of said folded web of film prior to passing said web over said folding surfaces, said holes exposing said tape so it can be grasped.

8. The machine recited in claim 1 wherein each of said surfaces comprises:

a hem plate;

a bottom plate; and means for spacing said plates from one another to form a surface which decreases in width.

9. The machine recited in claim 1 wherein each of said surfaces comprises a planar plate forming a folding board.

10. The machine recited in claim 4 wherein said surfaces have portions of constant width which extend from the point where they are said maximum distance apart to the point where said bags leave said board.

11. The machine recited in claim 10 wherein said portions of constant width converge to a line, said portions having a cut-out area for turning out said hem.

12. The machine recited in claim 10 wherein said portions of constant width converge to a space between said surfaces where said bags leave said surfaces, said hem being turned out in said space.

* * * * *